US008403820B2

(12) United States Patent
Zoeckler

(10) Patent No.: US 8,403,820 B2
(45) Date of Patent: Mar. 26, 2013

(54) PAPERBOARD CARTONS WITH LAMINATED REINFORCING RIBBONS AND TRANSITIONED SCORES AND METHOD OF MAKING SAME

(75) Inventor: Michael D. Zoeckler, Roswell, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 1032 days.

(21) Appl. No.: 12/020,859

(22) Filed: Jan. 28, 2008

(65) Prior Publication Data

US 2008/0119343 A1 May 22, 2008

Related U.S. Application Data

(63) Continuation of application No. 09/818,023, filed on Mar. 27, 2001, now abandoned, which is a continuation-in-part of application No. 09/559,704, filed on Apr. 27, 2000, now Pat. No. 8,317,671.

(51) Int. Cl.
*B31B 1/62* (2006.01)

(52) U.S. Cl. ..... 493/89; 493/59; 493/77; 493/78; 493/94; 493/97; 493/381; 493/382

(58) Field of Classification Search ..... 493/95–97, 493/381
See application file for complete search history.

(56) References Cited

U.S. PATENT DOCUMENTS

| | | | |
|---|---|---|---|
| 504,551 | A | 9/1893 | Brandstaedter |
| 516,983 | A | 3/1894 | Beery |
| 997,263 | A | 7/1911 | Bird |
| 1,402,261 | A | 1/1922 | Smith |
| 1,564,374 | A | 12/1925 | Smith |
| 1,600,396 | A | 9/1926 | Campbell et al. |
| 1,627,811 | A | 5/1927 | Smith |
| 1,627,812 | A | 5/1927 | Smith |
| 1,693,023 | A | 11/1928 | Cleaves |
| 1,745,385 | A | 2/1930 | Smith |
| 1,762,702 | A | 6/1930 | Smith |

(Continued)

FOREIGN PATENT DOCUMENTS

| | | |
|---|---|---|
| CA | 2205401 | 11/1995 |
| CA | 2229180 | 8/1996 |

(Continued)

OTHER PUBLICATIONS

Supplementary European Search Report—EP 01 92 3042.

*Primary Examiner* — Christopher Harmon
(74) *Attorney, Agent, or Firm* — Womble Carlyle Sandridge & Rice, LLP

(57) ABSTRACT

A method of making reinforced paperboard cartons comprises the steps of advancing a web of paperboard along a path and progressively laminating at least one ribbon of reinforcing material to the advancing web of paperboard. The ribbon of reinforcing material, which also may be paperboard, has a width less than the width of the web of paperboard and is applied with adhesive at a selected location across the width of the web. The web and its laminated ribbon are cut into sheets of a predetermined size and the sheets are die-cut and scored with fold lines to form carton blanks. The fold lines may transition from non-reinforced to reinforced portions of the blank and a special transition zone is contemplated to accommodate the transition. The carton blanks are subsequently formed into cartons for receiving articles, the laminated reinforcing material providing reinforcement in selected portions of the cartons. Multiple ribbons and multiple layers of ribbons may be laminated to the web in respective selected locations to provide reinforcement in more than one portion of the cartons. Reinforcing ribbons may be deformed or altered to exhibit, for instance, corrugations or perforations prior to being adhered to the base sheet. Reinforced cartons and carton blanks made by the method also are provided.

22 Claims, 9 Drawing Sheets

U.S. PATENT DOCUMENTS 1,762,703 A 6/1930 Smith
1,782,611 A 11/1930 Hackett et al.
1,784,317 A 12/1930 Stokes
1,880,288 A 10/1932 Stokes
1,922,506 A 8/1933 Stokes
1,976,211 A 10/1934 Bickford
2,008,608 A 7/1935 Lloyd
2,048,693 A 7/1936 Grupe
2,095,389 A 10/1937 Kondolf
2,114,948 A 4/1938 Wehner et al.
2,145,682 A 1/1939 Bergstein
2,177,894 A 10/1939 Lakso
2,285,356 A 6/1942 Ridderstrom
2,307,142 A 1/1943 Lee
2,558,918 A 3/1947 Zinn, Jr.
2,502,117 A 3/1950 Anderson
2,646,914 A 7/1953 Claff et al.
2,751,964 A 6/1956 Reynolds
2,772,718 A 12/1956 Magnuson
2,776,072 A 1/1957 Forrer
2,776,608 A 1/1957 Fischer et al.
2,862,425 A 12/1958 Swaim et al.
2,933,228 A 4/1960 Reynolds
2,969,906 A 1/1961 Claff et al.
3,113,492 A 12/1963 Foss
3,113,898 A * 12/1963 Tross ..... 156/215
3,149,768 A 9/1964 Aller
3,179,012 A 4/1965 Hoff
3,194,474 A 7/1965 Rumberger
3,240,611 A 3/1966 Williams
3,252,385 A 5/1966 Balocca
3,379,102 A 4/1968 James et al.
3,411,689 A 11/1968 Brackett
3,468,734 A 9/1969 Shields
3,526,566 A * 9/1970 McIlvain, Jr. et al. ..... 428/121
3,590,699 A 7/1971 Foley, Jr. et al.
3,608,047 A 9/1971 Wiggins
3,653,578 A 4/1972 Wood
3,735,674 A 5/1973 Haddock
3,741,859 A 6/1973 Wandel
3,750,538 A 8/1973 Confer
3,830,140 A 8/1974 Rausing et al.
3,831,929 A 8/1974 Hellmer
3,878,771 A 4/1975 Malcolm
3,913,822 A 10/1975 Heaps, Jr.
3,933,568 A 1/1976 Schmermund
3,945,870 A 3/1976 Johnsen
4,034,907 A 7/1977 Engdahl, Jr.
4,059,220 A 11/1977 Lorenz
4,064,206 A 12/1977 Seufert
4,146,418 A 3/1979 Walter
4,177,715 A 12/1979 Meyers
4,177,936 A 12/1979 Ford, Jr. et al.
4,196,035 A 4/1980 Reil
4,232,074 A 11/1980 Chavannes
4,260,442 A 4/1981 Ford et al.
4,373,929 A 2/1983 Smith
4,437,850 A 3/1984 Ono
4,452,837 A 6/1984 Clausen et al.
4,559,259 A * 12/1985 Cetrelli ..... 428/167
4,560,429 A 12/1985 Credali et al.
4,567,070 A 1/1986 Karass
4,586,643 A 5/1986 Halabisky et al.
4,608,038 A 8/1986 Virta et al.
4,693,413 A 9/1987 McFarland et al.
4,733,916 A 3/1988 Seufert
4,741,728 A 5/1988 Bakx
4,785,696 A 11/1988 Martiny
4,860,774 A 8/1989 Becker
4,866,913 A 9/1989 Rebischung
4,905,864 A 3/1990 Balin
4,935,082 A 6/1990 Bennett et al.
4,946,540 A 8/1990 Mitchard
5,012,825 A 5/1991 Lindemann et al.
5,055,151 A 10/1991 Duffy
5,073,162 A * 12/1991 Campbell et al. ..... 493/396
5,087,498 A 2/1992 Nedblake et al.
5,097,651 A 3/1992 Decottignies et al.
5,108,355 A 4/1992 Walsh
5,147,480 A 9/1992 Lang
5,163,891 A 11/1992 Goldsborough et al.
5,169,082 A 12/1992 Da Silva et al.
5,211,618 A 5/1993 Stoltz
5,224,919 A 7/1993 Walsh
5,230,736 A 7/1993 Schnodewind
5,236,778 A 8/1993 Landis et al.
5,242,720 A 9/1993 Blake
5,251,819 A 10/1993 McHugh
5,393,295 A * 2/1995 Knecht ..... 493/403
5,418,027 A 5/1995 Conboy
5,426,130 A 6/1995 Thurber
5,429,577 A 7/1995 Simpson et al.
5,447,270 A 9/1995 McNown
5,551,938 A 9/1996 Stone
5,690,601 A 11/1997 Cummings et al.
5,736,470 A 4/1998 Schneberger et al.
5,746,871 A 5/1998 Walsh
5,772,569 A 6/1998 Janhonen
5,791,239 A 8/1998 Lauderbaugh et al.
5,845,841 A 12/1998 Canning
5,944,252 A 8/1999 Connelly et al.
6,015,084 A 1/2000 Mathieu et al.
6,162,155 A 12/2000 Gordon et al.
6,221,192 B1 4/2001 Walsh
6,332,488 B1 12/2001 Walsh
6,436,217 B1 8/2002 Heertjes
6,637,646 B1 10/2003 Muise et al.
6,854,639 B2 2/2005 Walsh
7,201,714 B2 4/2007 Zoeckler
2001/0048022 A1 12/2001 Zoeckler

FOREIGN PATENT DOCUMENTS

CA 2346103 4/2000
DE 2541324 9/1975
DE 195 06 647 A1 9/1996
EP 0 231 082 A2 8/1987
JP 49-112779 10/1974
JP 8-310525 11/1996
JP 11100066 A 4/1999
WO WO 97/06059 2/1997
WO WO 01/94125 A1 12/2001

* cited by examiner

PAPERBOARD CARTONS WITH LAMINATED REINFORCING RIBBONS AND TRANSITIONED SCORES AND METHOD OF MAKING SAME

REFERENCE TO RELATED APPLICATION

This application is a continuation of co-pending U.S. patent application Ser. No. 09/818,023, filed Mar. 27, 2001 now abandoned, which is a continuation-in-part of U.S. patent application Ser. No. 09/559,704, filed on Apr. 27, 2000 now U.S. Pat. No. 8,317,671, which are hereby incorporated herein by reference in their entirety.

BACKGROUND OF THE INVENTION

1. Field of the Invention

This invention relates generally to article packaging and more specifically to the fabrication of paperboard cartons into which a plurality of articles can be packaged for transport and sale.

2. Description of the Related Art

Paperboard cartons of various design and construction have long been used by the packaging industry to package a wide variety of articles such as canned and bottled drinks, food items, detergents, and more. In general, paperboard cartons are erected or converted from paperboard blanks that are die-cut or rotary-cut from long webs of paperboard as the paperboard is drawn progressively from large rolls. Fold lines are scored in the blanks to define the various panels of the cartons and to aid in the conversion of the blanks into their final carton shapes. Traditionally, the fold lines are formed by an array of thin metal blades known as a "rule" embedded within the head of a platen die cutter or within the drum of a rotary die cutter. These blades of the rule extend partially into aligned groves or slots formed in a counter plate that underlies a paperboard blank to crease and form scores in the blank.

In some cases, such as in beer and soft drink packaging, carton blanks are pre-glued and provided to packagers in the form of substantially flat knocked down sleeves that are erected in a packaging machine into open ended cartons for receiving articles. In other cases, the blanks are provided in a completely flat configuration, in which case the blanks typically are folded around groups of articles and glued by the packaging machine. In either case, the conversion of blanks usually is performed at the time of packaging by specialized conversion stations that are part of large continuous packaging machines. In this way, the flat or pre-glued and knocked down paperboard blanks can be shipped economically to the packager in palletized stacks.

When making paperboard carton blanks from a web of paperboard, the web usually is pre-cut to a specified predetermined width from a wider web of paperboard stock. The pre-cutting of the web to width generally takes place at the paper mill. The width of the web in each case is dictated by the size and shape of the cartons to be made from the web and is specified to the paper mill by a carton fabricator. For example, a web of paperboard stock may have a width of 64 inches whereas a particular carton blank may require a web 48 inches wide. In such an example, a strip of paperboard 16 inches wide (or two strips that total 16 inches in width) typically will be cut from the web of paperboard stock by the paper mill to form the required 48 inch-wide web. These strips, known in the industry as "trim," traditionally have had reduced value and in some cases are sold at low cost for secondary uses such as the making of shirt collar stiffeners used in the garment industry. In general, the creation of trim in the process of making paperboard web has long been a problem for paperboard manufacturers.

Occasionally, errors by paperboard manufacturers result in rolls of paperboard web that may be substandard for a variety of reasons and thus not usable in the fabrication of paperboard cartons. In other cases, paperboard web manufactured for a particular customer may not meet specifications and thus cannot readily be used. Such substandard and off-spec paperboard is known in the industry as "cull" and also has had reduced value, sometimes being reconstituted into pulp for making new paper. In general, there has been little use for trim and cull in the paperboard carton making industry.

In many packaging applications, the cartons into which articles are packaged must exhibit enhanced strength at least in selected regions to contain the articles securely. This is particularly true in cases where the articles are relatively heavy and are stacked atop one another in their cartons for shipment and sale. For example, canned and bottled beverages, which typically may be packaged in groups of 6, 12, or 24, are inherently relatively heavy and typically are stacked several cartons high on pallets for shipment to retail stores. The cartons into which these beverages are packed therefore must be strong enough to hold the groups of cans or bottles securely together and to resist tearing or "blowing out" even when under the substantial weight of several layers of stacked cartons. In other applications, such as, for example, cartons of boxed fruit drinks, the cartons themselves must provide at least some of the strength and rigidity necessary to resist crushing when layers of cartons are stacked atop one another. This is because the individual drink containers lack the rigidity of bottles or cans and cannot themselves bear the entire weight of a stack of cartoned fruit drinks.

In applications such as these, traditional paperboard cartons have sometimes proven inadequate to provide the required strength and rigidity. As a result, many packagers have turned to carton materials known in the industry as small flute corrugated and/or micro-flute, and/or B-corrugated material, which are corrugated paper products. In the balance of this specification, all such corrugated material will be referred to as and included within the definition of "micro-flute." In general, micro-flute is fabricated from a core of paper material formed with a large number of relatively small corrugations sandwiched between facing sheets of flat paper. Micro-flute does tend to provide the strength and rigidity required in many packaging applications; however, it also has significant inherent problems and shortcomings including its generally higher price compared to paperboard. In addition, carton blanks made of micro-flute can be more expensive in some weights to ship than paperboard blanks because their greater thickness limits the number of blanks that can be stacked on standard sized pallet. Further, in some cases, specialized conversion machinery is required to convert the blanks to cartons, increasing the cost of the packaging process. Finally, the printing of high quality graphics on micro-flute has sometimes proven to be difficult. Thus, micro-flute has not provided a completely satisfactory solution as a carton making material in packaging applications where enhanced carton strength, rigidity, and printability is required.

Attempts have been made to improve the strength and rigidity of paperboard cartons to provide a viable alternative to micro-flute where added strength and rigidity are required. These attempts have included laminating two or more webs or sheets of standard thickness paperboard together to create thicker multi-ply paperboard from which carton blanks can be cut. However, while this approach increases the strength and rigidity of resulting cartons, it essentially results in a doubling of the paperboard required per carton and a consequent increase in material and shipping costs. Further, the formation of score or fold lines in and the folding of multiple ply paperboard cartons can be problematic due to the added thickness of paperboard that must be folded. For these and other reasons, such multi-layer laminated paperboard has not proven to be an acceptable alternative to micro-flute.

Other attempts to provide alternatives to micro-flute have included the separate fabrication of custom stiffening inserts, which are installed in individual cartons after the cartons are converted from carton blanks. Such inserts have been used, for example, in detergent cartons to provide added strength for stacking and an internal moisture barrier and in beverage cartons to provide separators. However, installing inserts requires expensive specialized machinery, increases material and packaging costs, and can slow the packaging process significantly.

A problem with cartons in general, including micro-flute and paperboard cartons, is that they tend to tear and fail in areas of particularly high stress such as in certain corners of the cartons where folded panels meet. Such tears, once started, often can spread, resulting in the separation of carton panels and ultimately in carton blow-out. Attempts to address this problem have included providing double folding flaps and/or tongues in carton blanks to reinforce the corners and, in some cases, gluing special corner reinforcements in cartons to inhibit tearing. Such attempts have not been completely successful.

In some situations, a product manufacturer may specify that cartons into which products are to packaged be printed on the inside in addition to the printing of logos and graphics on the outside of the carton. For example, a manufacturer may want to print contest rules, product instructions, special incentive coupons, or the like on the inside of product cartons. In the past, such interior printing has required that relatively expensive and time-consuming two-sided printing techniques be used to print both sides of a web from which the carton blanks are cut. Further, since interior surfaces of cartons generally are not coated for printing, the quality and character of printing available for interior carton surfaces has been limited.

A need therefore exists for an improved paperboard carton that provides the strength and rigidity of cartons made from micro-flute at a competitive cost. A related need exists for an efficient and cost effective method of making such paperboard cartons that uses traditional paperboard carton fabrication machinery and that does not substantially increase material costs associated with the fabrication process. Further needs exist for more efficient methods of providing paperboard carton inserts such as stiffeners and dividers and for providing higher quality printing visible on the interior surfaces of cartons where such printing is desired. It is to the provision of a method of making a paperboard carton and a resulting carton that addresses these and other needs and that overcomes the problems of the prior art that the present invention is primarily directed.

SUMMARY OF THE INVENTION

Briefly described, the present invention, in a preferred embodiment thereof, comprises a method of making reinforced paperboard cartons having enhanced strength and rigidity similar to that of micro-flute in selected regions where strength and rigidity are required. The method comprises the steps of advancing a web of paperboard along a path. The web of paperboard has a predetermined width according to the size of cartons to be made and preferably is drawn from a large roll of paperboard. The web of paperboard may or may not be pre-printed on the side that will become the outside of the finished carton with, for example, logos and graphics, according to application specific requirements. The web also may be printed on both sides if desired.

As the web of paperboard is advanced along the path, one or more ribbons of reinforcing material, each having a width less than the width of the paperboard web, is progressively applied to the web. Each ribbon preferably is applied with adhesive to the side of the web that will become the inside of the finished cartons and is positioned at a predetermined location across the width of the web. The location of each ribbon is selected to provide multiple layers or laminations of material in specific regions of finished cartons where enhanced strength and/or rigidity will be required such as, for example, in the side walls of the carton. Preferably, the ribbons of reinforcing material also are formed of paperboard and most preferably are pre-cut or slit to desired widths from paperboard trim or cull that otherwise may have reduced value. The ribbons are drawn from rolls that are pre-positioned to locate the ribbons properly on the web, advanced along and adjacent to the path of the web, supplied with adhesive on one side, and progressively brought into engagement with and compressed against the advancing paperboard web to adhere the ribbons to the web. In one embodiment, one or more of the ribbons may be pre-printed on one or both sides with application specific indicia that ultimately will be exposed on the inside of finished cartons.

After the reinforcing ribbons are laminated to the advancing web, the web may be cut into sheets of a predetermined size. The sheets subsequently may be die-cut and scored with fold lines as required to form carton blanks defining the various panels and tabs that ultimately will become the walls of finished cartons. In this regard, unique multi-width fold lines may be formed where a fold line transitions across the edge of a reinforcing ribbon. Such multi-width fold lines may be scored according to the invention with equally unique multi-point scoring rules in a platen or in-line rotary die cutter. The cut and scored carton blanks may be palletized and shipped to packagers, where the blanks are converted into cartons and packed with articles such as, for example, beverage containers or food items. When converted to cartons, the previously positioned and applied paperboard reinforcing ribbons form multiple layers or laminations of paperboard in selected portions of the cartons such as, for example, in their sides, where enhanced structural integrity is required. By appropriately selecting, sizing, and positioning the reinforcing ribbons, paperboard cartons having strength and rigidity comparable or superior to that provided by cartons made of micro-flute are obtained. Further, through judicious use of trim and cull in making the reinforcing ribbons, paperboard cartons made by the method of the present invention can be economically viable alternatives to cartons made of micro-flute.

In addition to providing paperboard cartons comparable in strength to micro-flute cartons, the present invention offers possibilities that are not obtainable with micro-flute. For example, the reinforcing ribbons of the present invention may be pre-printed on one side with high-quality graphics and indicia that is visible on the inside of finished cartons, all without requiring a two-sided printing process. Further, only a portion of one or more ribbons may be adhered to the paperboard web, with another portion being inwardly foldable to define interior carton structures such as stiffeners and dividers without the need for the insertion of a separate liner. If desired, the ribbons may be passed through special embossing or perforating rollers prior to being adhered to the base sheet to provide, for example, reinforcing ribbons that are corrugated, fluted, or perforated of offer enhanced strength or adhesion properties. Additional advantages are also provided, as will become more apparent below.

Thus, a unique reinforced paperboard carton and method of its manufacture is now provided that successfully addresses the problems and shortcomings of the prior art. The carton has structural integrity comparable to cartons previously made of micro-flute but is made of traditional paperboard material, which is easily converted to cartons in packaging machines with standard conversion machinery. The carton is economically competitive with cartons formed of micro-flute because of the unique use of trim and cull in forming the reinforcing ribbons and because the method of making the carton blanks can be practiced with existing paperboard fabrication machinery. The forgoing and other features, objects, and advantages of the invention will become more apparent upon review of the detailed description of the preferred embodiments set forth below when taken in conjunction with the accompanying drawing figures, which are briefly described as follows.

DETAILED DESCRIPTION OF THE PREFERRED EMBODIMENTS

Figure 3:
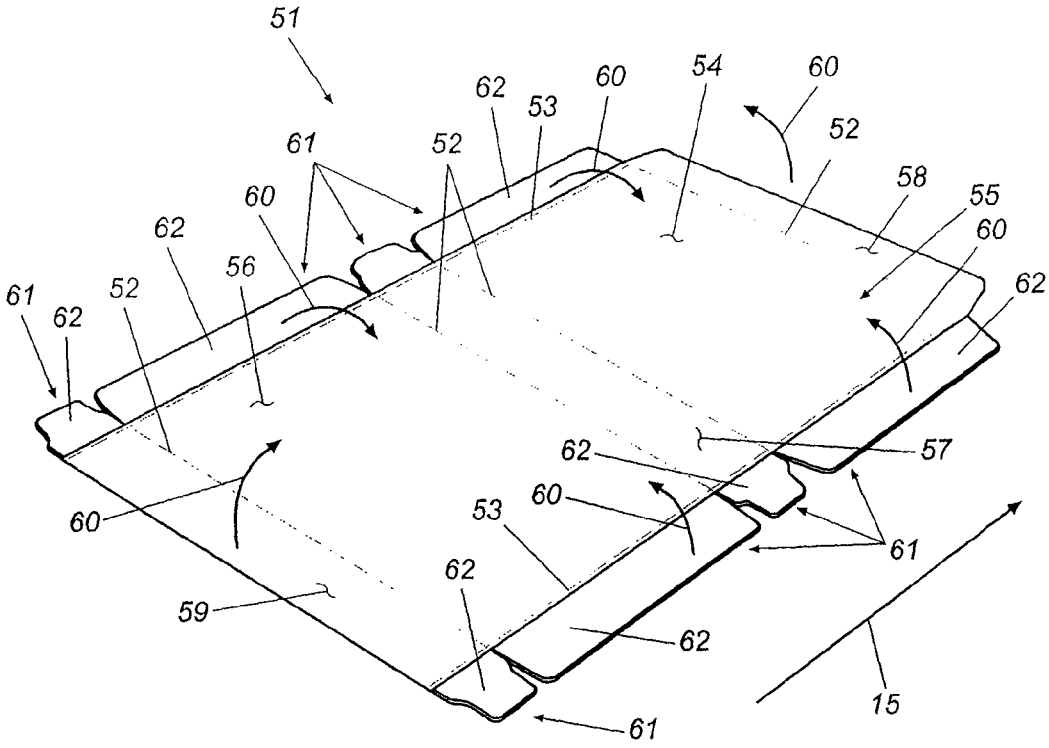
FIG. 3 is a perspective view of a possible configuration of a paperboard carton blank that embodies principles of the invention.

As mentioned above, carton blanks may be provided in the form of pre-glued knocked down sleeves or completely flat sheets depending upon the type of packaging operation in which they are to be used. The carton blank shown in FIG. 3 is of the former type and typically is partially folded and glued at the carton manufacturing location and shipped to a packager in the form of a knocked down sleeve. This sleeve, then, is erected by the packaging machinery into an open-ended carton into which product is inserted before the carton is sealed shut. This type of carton typically is used in most beer and soft drink bottling plants. The carton shown in FIG. 8, on the other hand, typically is formed from a carton blank that is shipped completely flat, folded around product in the packaging machine, and glued shut. This latter type of carton blank is different than the former in that the gluing of the carton to form a sleeve is done at the product production and/or packaging facility rather than at the carton fabricating facility. The present invention will be described for the most part in terms of making a flat carton blank typified by the carton of FIG. 8. However, it should be understood that the invention is not limited to the fabrication of flat carton blanks, but also includes the fabrication of pre-glued knocked down carton sleeve blanks as well as other types of carton blanks.

Figure 1:
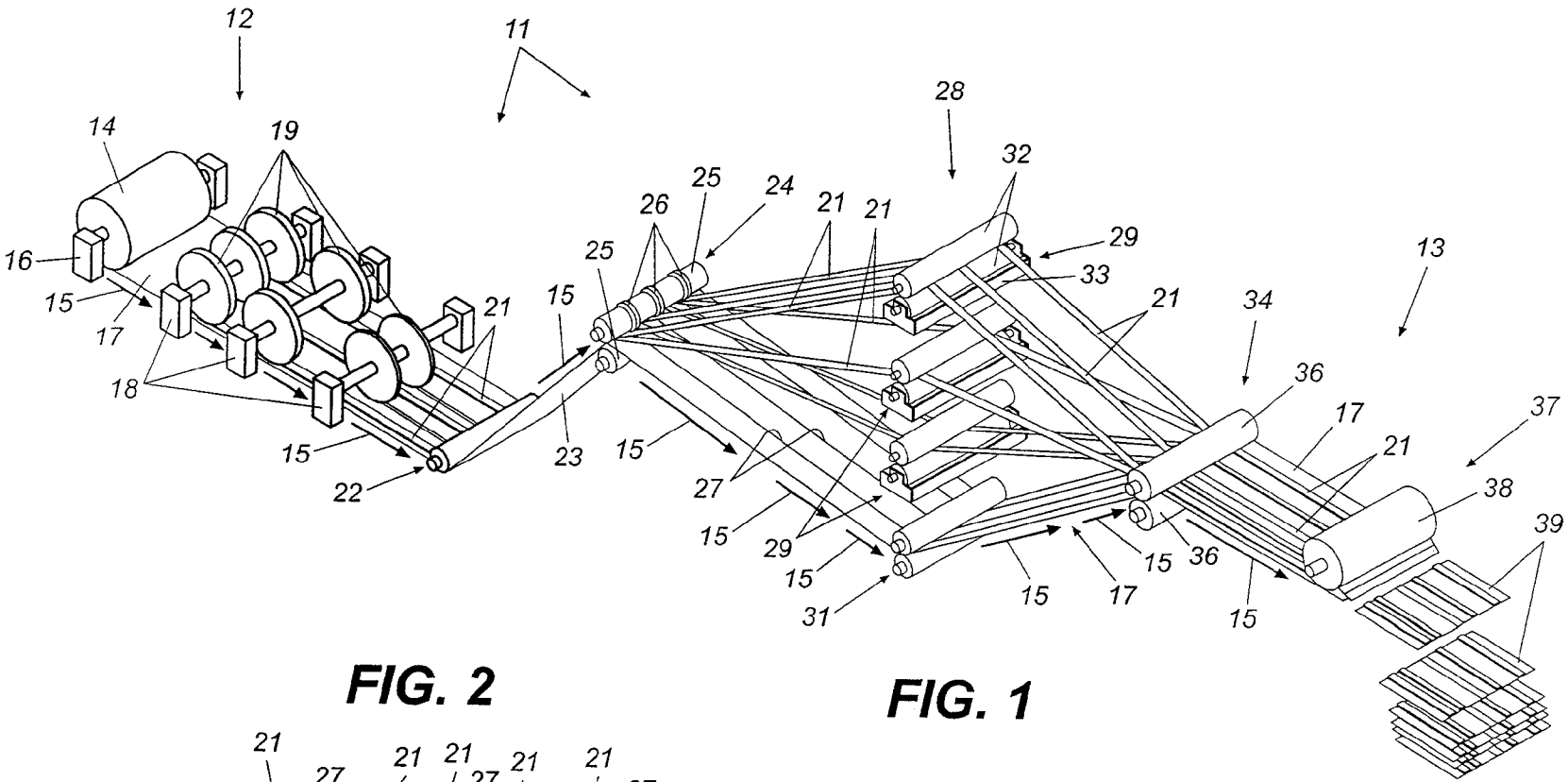
FIG. 1 is a perspective illustration of a method of making reinforced paperboard carton blanks that embodies principles of the present invention in a preferred form.

Referring now in more detail to the drawings, wherein like numerals refer, where appropriate, to like parts throughout the several views, FIG. 1 illustrates a fabrication line 11 for making reinforced paperboard carton blanks according to a preferred embodiment of the invention. The various stations along the fabrication line 11 are illustrated in simplified functional form for clarity of description. It will be understood, however, that the fabrication line and the machinery making up the various stations therealong are standard machinery in the paperboard making industry and are well known by those of skill in the art. Further, a detailed description of the machinery that makes up the fabrication line is not necessary to a complete disclosure and understanding of the invention. Accordingly, this machinery is not described in detail here.

The fabrication line 11 in FIG. 1 has an upstream end 12 and a downstream end 13 and the various elements used in the making of paperboard blanks according to the invention flow along paths in a direction extending generally from the upstream end toward the downstream end of the line. A large roll 14 of a paperboard web 17 is rotatably mounted on a pair of mandrels 16 located at the upstream end of the fabrication line 11. In carrying out the method of the invention, the paperboard web 17, which is pre-cut to a required width as described above, is drawn from the roll 17 and advanced along a path, generally indicated by arrows 15, that extends past the various stations of the fabrication line. In one embodiment, the paperboard web 17 may be preprinted on one side, as indicated at 23, with indicia such as application specific graphics, trademarks, and logos; however, such preprinting is not desired is some applications and should not be considered a requirement or limitation of the invention. Alternatively, the web may be printed on both sides, which is desirable for some applications.

Mandrels 18, three of which are illustrated in FIG. 1, are disposed at spaced locations along the path 15 adjacent the upstream end 12 of the fabrication line 11. Ribbons 21 of reinforcing material, each having a width less than the width of the paperboard web 17, are rolled onto relatively narrow rolls 19 and the rolls 19 are rotatably mounted on the mandrels 18. The ribbons 21 of reinforcing material are progressively drawn from the rolls 19 along with the web 17 and initially are disposed atop and move along the path 15 with the web 17. Each of the mandrels 18 may carry multiple rolls 19 of ribbons 21 and each of the rolls 19 may be positioned at any desired location across the width of the mandrel. Further, each of the ribbons 21 of reinforcing material may be cut to any desired width less than the width of the paperboard web 17.

As the web 17 and ribbons 21 are drawn from their respective rolls and advance along the path 15, the ribbons are positioned, according to the locations of their rolls 19 on mandrels 18, at predetermined locations across the width of the web 17. In the configuration illustrated in FIG. 1, for example, the rolls 19 are positioned such that a double layer of ribbons 21 is located adjacent each of the opposed edge portions of the web, a single ribbon is located in the central portion of the web, and a pair of relatively narrow ribbons are disposed on either side of the centrally located ribbon. By appropriately positioning the rolls 19 on the mandrels 18, virtually any placement and configuration of ribbons 21 of reinforcing material may be obtained, as described in more detail below.

The reinforcing material from which the ribbons 21 are formed may be any of a variety of appropriate materials such as, for example, thin plastic, fiberglass, woven or non-woven webs, or foam, and these and other materials are considered to be within the scope of the invention. Preferably, however, the ribbons also are made of paperboard and most preferably are cut or slit from paperboard trim or cull that otherwise has little or no commercial value. The invention will be described hereinafter in terms of ribbons of paperboard reinforcing material for ease and clarity of understanding. It should be understood, however, that the term "paperboard" when used in this context is intended to encompass and include any material with the physical and mechanical attributes necessary to provide the requisite reinforcing properties.

As the paperboard web 17 and ribbons 21 advance along the path 15, they move through a traditional de-curling station 22, where the paperboard of the web and ribbons is flattened and any curl that may have been induced by rolling the paperboard onto rolls 14 and 19 is removed. From the de-curling station 22, the web and ribbons advance further along the path 15 to a scoring station 24, which includes a pair of rollers 25 along which one or more scoring wheels 26 are disposed. The scoring wheels 26 are selectively positioned across the width of the rollers 25 to score the web 17 with longitudinally extending fold lines 27, along which carton blanks made by the method of the invention ultimately will be folded when converted into cartons.

As described in more detail below, some of the fold lines 27 may be located adjacent or along an edge of a reinforcing ribbon 21. In such cases, these fold lines preferably are carefully located a predetermined short distance from the edge of the ribbon so that the ribbon will not adversely affect or interfere with the folding of the paperboard along the fold lines. Alternatively, it may be desirable to locate some fold lines in regions of the carton blank where reinforcing ribbons are positioned so that the ribbons and base sheet are folded when the carton is erected. In these cases, it is likely that fold lines will transition from the thinner or lower caliper base sheet to the thicker or higher caliper reinforced regions. A method and apparatus for forming such transitioned fold lines in such a way that they do not cause cracking or otherwise interfere with the folding of the carton is described in more detail below. In FIG. 1, however, the scoring wheels 26 are located to provide substantially equally spaced fold lines across the width of the paperboard web 17. It will be understood, however, that any number of fold lines at any number of locations across the web, or no fold lines, as determined by the desired final shape and size of cartons being made, are possible and within the scope of the invention.

With the fold lines 27 scored in the paperboard web 17, the web 17 advances along the path 15 to a pair of guide rollers 31 and the paperboard reinforcing ribbons 21 diverge from the web 17 and advance to a gluing station 28 for receiving adhesive. In the illustrated embodiment, the gluing station 28 comprises an array of traditional adhesive applicators 29, each having a pair of nip rollers 32 between which one or more paperboard reinforcing ribbons pass. The lower nip roller 32 of each of the applicators 29 is partially immersed in an appropriate liquid adhesive contained within a flooded nip bath 33. As the paperboard reinforcing ribbons 21 pass between the nip rollers, a layer of adhesive is transferred from the lower nip roller of each pair to the bottom side (as seen in FIG. 1) of each ribbon 21. An array of three adhesive applicators 29 are illustrated in FIG. 1 for applying adhesive to the seven paperboard reinforcing ribbons in the illustrated embodiment. Fewer or more than three adhesive applicators 29 may be used as necessary depending upon the number and configuration of reinforcing ribbons required in a particular application.

Means other than nip rollers and nip baths for applying adhesive to the ribbons may be used to apply adhesive to the ribbons. Such alternative means include adhesive sprays, which commonly are used in the paperboard industry. Adhesive spraying mechanisms for use in the paperboard industry are commercially available and may be obtained, for example, from the Nordson Company. In any case, i.e. whether applied with nip rollers, sprayers, or otherwise, adhesive may be applied to the reinforcing ribbons 21 in a continuous coat, a discontinuous coat, a stitch-glued pattern, a strand, or otherwise. Preferably, the adhesive is applied in such a way as to minimize the amount of adhesive required to provide adequate paperboard-to-paperboard bonding. In one embodiment of the present invention, adhesive is applied along only one side of one or more of the ribbons to produce a finished carton having inwardly foldable internal structures such as separators and stiffeners, as described in more detail below.

The paperboard web 17 advances from the guide rollers to the compression station 34, which includes a pair main compression rollers 36, that also may function as pull rollers. Likewise, the adhesive bearing paperboard ribbons 21 advance from the gluing station 28 toward the compression station 34 and toward the paperboard web 17. At the compression station 34, the paperboard ribbons 21 and paperboard web 17 pass between the main compression rollers 36. The compression rollers 36 are set to compress the reinforcing ribbons 21 and the web 17 together with sufficient pressure to bond the adhesive and thus the ribbons to the web, or to other underlying ribbons in cases where multiple laminations of ribbons are to be applied to the web 17. In this way, the ribbons are progressively applied to the advancing web of paperboard at selected locations across the width of the web, as determined by the placement of rolls 19 on mandrels 18.

From the compression station 34, the paperboard web 17, possibly with scored fold lines 27, and with the paperboard reinforcing ribbons 21 laminated thereto proceeds toward the downstream end 13 of the fabrication line 11 and toward a cutting station 37. In the illustrated embodiment, the cutting station 37 includes a traditional rotary knife assembly 38, which rotates to cut the web 17 across its width into rectangular sheets of a predetermined size. Each sheet has a width equal to the width of the paperboard web 17 and a length determined by the settings and operation of the rotary knife assembly 38. Means other than a rotary knife such as, for example, a traversing knife assembly or a platen cutter may be substituted for the rotary knife of the illustrated embodiment and these and other means for cutting the web should be considered equivalent to the illustrated rotary knife assembly.

Once the web 17 is cut into sheets 39, the sheets may be stacked and delivered to a die cutter, where the sheets are cut and scored in a standard platen die-cutting operation to form carton blanks having the various foldable tabs and panels necessary to form paperboard cartons embodying principles and features of the invention.

As an alternative to cutting the web 17 into sheets 39 and subsequently die-cutting the sheets 39 to form paperboard blanks, the rotary knife assembly 38 in FIG. 1 may be replaced with a platen die cutter or rotary inline die cutter, in which case the web 17 is cut and scored immediately into carton blanks at the downstream end of the fabrication line 11 and the step of first cutting the web into sheets is eliminated. In either case, once the carton blanks are cut and scored, they may be palletized and shipped to product packagers, where the blanks are converted into cartons and packed with articles in the usual way.

When the blanks are converted, the ribbons of reinforcing paperboard laminated to the carton blanks form multiple layers of paperboard in selected portions of the cartons and thus reinforce the cartons in these portions. The locations of the ribbons are carefully determined in advance such that, when the carton blank is converted to a carton, the ribbons and thus reinforcement is provided in selected portions of the cartons such as, for example, in their side walls, where added strength and/or rigidity are required. In one embodiment, discussed in more detail below, some of the reinforcing ribbons may span the locations of folds, in which case the ribbon and base sheet are scored along the fold lines. When thus folded, the reinforcing ribbon is formed into an L-shape, which provides a post-like corner that can enhance greatly the structural integrity and load bearing capacity of the carton. In fact, it has been discovered empirically that such posts, when judicially positioned, can provide up to 75 percent or more of the load bearing capacity of an erected carton. In any case, reinforced paperboard cartons made by the method of this invention have been found to exhibit strength and rigidity in the reinforced portions that is comparable or superior to that of cartons made from micro-flute.

With the forgoing specific example in mind, it will be appreciated that, in one embodiment, the present invention is a unique method of making reinforced paperboard cartons. The method includes the steps of advancing a web of paperboard along a path, the web of paperboard having a width. At least one ribbon of reinforcing material having a width less than the width of the paperboard web is progressively applied, preferably with adhesive, to the advancing web at a predetermined position across its width. The web with its applied reinforcing ribbon is cut to form carton blanks and the carton blanks are formed into cartons for receiving articles, the ribbon of reinforcing material providing reinforcement in selected portions of the cartons where added strength is required.

Figure 2:
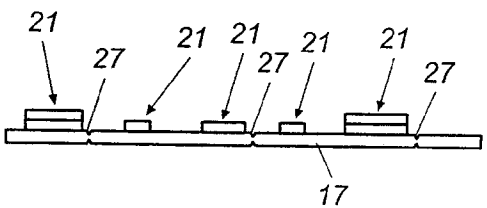
FIG. 2 is a cross-sectional view showing the profile of a carton blank made by the method illustrated in FIG. 1.

FIG. 2 is a cross-sectional view of the web 17 of FIG. 1 as it appears after the reinforcing ribbons 21 have been bonded to the web, such as just beyond the compression station 34. While this particular configuration may or may not correspond to that of an actual carton, it is presented along with FIG. 1 to illustrate clearly some of the variety of possible sizes and placements of reinforcing ribbons 21 and scored fold lines 27 that may be obtained through the method of the invention. In FIG. 2, the reinforcing ribbons 21 are applied at predetermined locations across the width of the web 17 such that a double layer of ribbons is disposed adjacent each edge portion of the web and a single ribbon is located intermediate the edges of the web. A relatively thin ribbon is located on either side of the centrally located ribbon and the web is scored to form longitudinally extending fold lines 27 spaced a short distance from the edges of some of the reinforcing ribbons.

FIG. 3 illustrates one possible configuration of an actual carton blank that may be formed by the method of the invention. The carton blank 51 has a base sheet 55 of paperboard material, which is a part of the continuous web of paperboard used to make the blank 51 according to the invention. The base sheet 55 has longitudinally extending fold lines 53, which, in this particular example, may have been scored at a scoring station 24 of a fabrication line 11 (FIG. 1) or during a die cutting operation, and transversely extending fold lines 52, which may have been scored during the die-cutting process. The fold lines 52 and 53 define a top panel 54, a bottom panel 56, a first side panel 57, and side panel tabs 58 and 59, which overlie one another when the carton blank is converted to form a second side panel of the carton. End tabs 61 are formed outboard of the longitudinally extending fold lines 53 and the end tabs are configured to be folded inwardly along the fold lines 53 when the blank is converted to form the ends of the carton.

Paperboard reinforcing ribbons 62 are laminated to the base sheet 55 according to the method of the invention. The reinforcing ribbons 52 are positioned along and increase the effective thickness of the end tabs 61 to reinforce the end tabs and provide enhanced structural integrity in the end portions of a carton converted from the blank. During conversion of the blank 51 into a carton, the various panels and tabs of the blank are folded generally inwardly along the scored fold lines 52 and 53 as indicated by arrows 60, and selected ones of the tabs are secured together with adhesive or otherwise to form a rectangular carton to be packaged with articles. The carton, when formed, has ends defined by the end tabs 61 that are reinforced by the paperboard reinforcing ribbons 62 laminated thereto to provided enhanced strength, rigidity, and tear or blow-out resistance in the ends of the carton. Thus, when the blank 51 is converted, it forms a reinforced paperboard carton having a plurality of panels defining sides and ends of the carton and a layer of reinforcing paperboard material applied to selected ones of the panels to reinforce the carton in selected regions defined by the reinforced panels.

Figure 4:
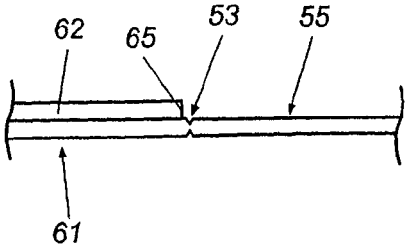
FIG. 4 is a sectional view illustrating a portion of a reinforced paperboard carton blank according to the invention and illustrating a preferred placement of a score line relative to the edge of an adjacent reinforcing ribbon.
Figure 5:
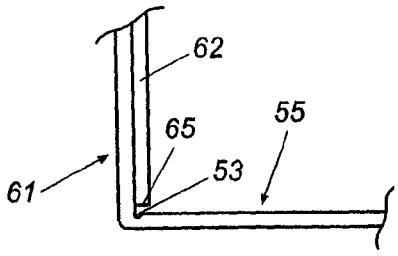
FIG. 5 is a sectional view of the portion of the reinforced paperboard carton blank of FIG. 3 with the blank folded along its fold line as it appears when the blank is converted to a carton.

FIGS. 4 and 5 illustrate one possible placement of the reinforcing paperboard ribbons 62 with respect to adjacent fold lines 53 to insure in such an embodiment that the added thickness of the ribbons does not interfere with the folding of the carton blank along the fold lines during conversion. As mentioned above, in other embodiments the fold lines may be located in regions where laminated reinforcing ribbons are present and certain fold lines may transition or cross the junction between a non-reinforced region and a reinforced region. Such other embodiments are discussed in more detail below. In the embodiment of FIGS. 4 and 5, however, the paperboard base sheet 55 has a longitudinally extending fold line 53 that defines an end tab 61 of the carton blank. Reinforcing paperboard ribbon 62 is laminated to the base sheet 55 in the region of the end tab 61 according to the present invention to provide reinforcement as described above. The inboard edge 65 of the ribbon 62 is spaced a predetermined short distance from the fold line 53. Thus, when the sheet 55 is folded along fold line 53 during conversion to a carton, as illustrated in FIG. 5, the space between the edge 65 of the ribbon and the fold line insures that the edge of the ribbon does not impact any of the panels of the blank or otherwise interfere with the folding process.

It has been found that a distance between a fold line and an edge of a reinforcing ribbon of about the thickness of the paperboard base sheet allows unimpeded folding of a carton blank along the fold line. It also has been found that such a distance is easily achieved and maintained when performing the method of this invention with standard paperboard making machinery as illustrated in FIG. 1. Of course, distances other that the preferred distance may be chosen according to application specific requirements and any appropriate distance is intended to be within the scope of the invention. Further, in some applications, reinforcing ribbons may be applied at locations on the paperboard web other than adjacent to fold lines. In these cases, the distance between edges of the ribbon and fold lines generally is not critical. Finally, as mentioned briefly above, fold lines also may be formed in regions where the base sheet is reinforced by reinforcing ribbons and certain fold lines may transition between thinner base sheet only regions and thicker reinforced regions.

FIGS. 6*a* through 6*h* are provided to illustrate some of the many possible configurations in which reinforcing ribbons may be applied to a paperboard web using the method of the present invention. Each of these figures is a cross-sectional view of a web with reinforcing ribbons applied thereto and longitudinally extending fold lines are scored in some of the figures. It should be understood that these figures do not necessarily represent configurations corresponding to actual carton blanks, but instead are generally simplified drawings selected for clarity in describing some of the many possible configurations of reinforcing ribbons. Also in this regard, the thickness of the paperboard web and reinforcing ribbons generally is exaggerated in FIGS. 6*a* through 6*h* for clarity of illustration.

Figure 6A:
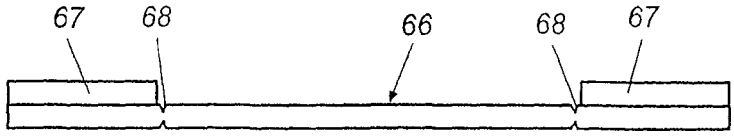
FIGS. 6*a* through 6*h* are cross-sectional views of carton blanks made by the method of the invention illustrating some of the possible configurations in which ribbons of reinforcing material may be applied to a paperboard base sheet.

In FIG. 6*a*, a the paperboard web forms a base sheet 66 having reinforcing paperboard ribbons 67 laminated thereto and extending along the opposed edge portions of the base sheet. Fold lines 68 are scored in the base sheet extending along and adjacent to the inboard edges of the reinforcing ribbons 67 to facilitate folding of the base sheet in the formation of a carton. A configuration of reinforcing ribbons similar to that of FIG. 6*a* may be selected, for example, when forming carton blanks such as the blank 51 illustrated in FIG. 3.

Figure 6B:
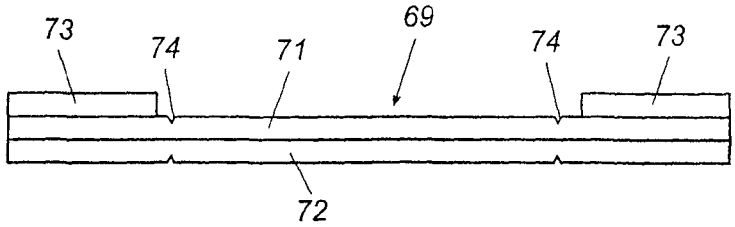

FIG. 6*b* illustrates a possible configuration similar to that of FIG. 6*a* but having a double thickness paperboard base sheet 69 formed from a first paperboard sheet 71 and a second paperboard sheet 72 laminated together. Reinforcing ribbons 73 are applied along the opposed edge portions of the base sheet 69 and fold lines 74 are scored in the base sheet to facilitate folding. Referring to FIG. 1, a configuration similar to that of FIG. 6*b* may be made by the method of the invention by, for example, mounting a second roll of full width paperboard on the mandrel 18 immediately upstream of the mandrel 16. Alternatively, a roll of double thickness laminated web may be made in advance in a separate process and mounted on mandrel 16.

Figure 6C:
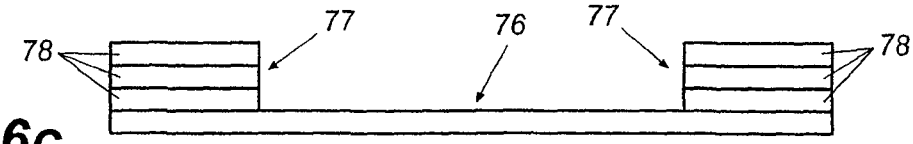

FIG. 6*c* illustrates the possibility of applying multiple laminations of reinforcing ribbons, one atop the other, to provide even more reinforcement in areas where further enhanced structural integrity may be required. In this figure, three stacked reinforcing ribbons 78 are applied along the opposed edge portions of a base sheet 76, to form multiply laminated reinforcing ribbons 77. Such a configuration may be formed by the method illustrated in FIG. 1 by aligning rolls 19 of reinforcing ribbons with each other on successive mandrels 18 so that the reinforcing ribbons overlie one another as they are drawn from their respective rolls. Alternatively, rolls of multi-ply pre-laminated reinforcing ribbons may be made in advance and mounted on mandrels 18 if desired to obtain similar results.

Figure 6D:
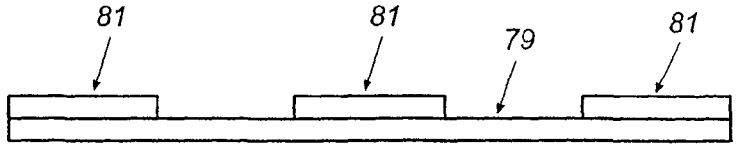

FIG. 6*d* illustrates the ability to apply multiple reinforcing ribbons at selected locations across the width of a paperboard web using the method of the invention. Here, three reinforcing ribbons 81 are applied to a paperboard base sheet 82, two along the opposed edge portions of the base sheet and one intermediate the edge portions. While the reinforcing ribbons 81 in FIG. 6*d* are illustrated with substantially the same width, it will be understood that each ribbon may have a different width and may be positioned at any desired location across the width of the base sheet according to a desired configuration and reinforcement requirements of a finished paperboard carton. Selective placement of the reinforcing ribbons is achieved in the method illustrated in FIG. 1 by selectively positioning the rolls 19 of reinforcing ribbon across the width of mandrels 18.

Figure 6E:
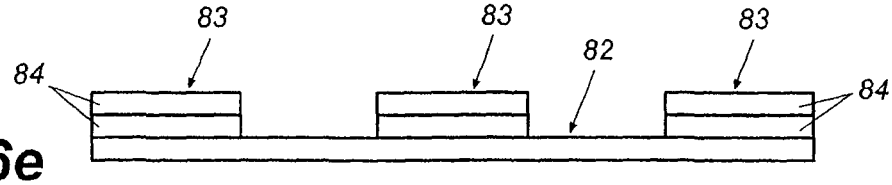

FIG. 6*e* illustrates the possibility of applying selectively positioned multi-layer reinforcing ribbons to a paperboard base sheet. Multiple layers of reinforcing ribbons 84 are applied atop each other on a base sheet 82 to form reinforcing ribbons 83, one extending along each of the opposed edge portions of the base sheet and one positioned intermediate the edge portions. Of course, any number of ribbons 83 may be applied, each of the ribbons 84 and resulting strips 83 may be any desired width, and the ribbons may be applied at any desired location across the width of the base sheet 82.

Figure 6F:
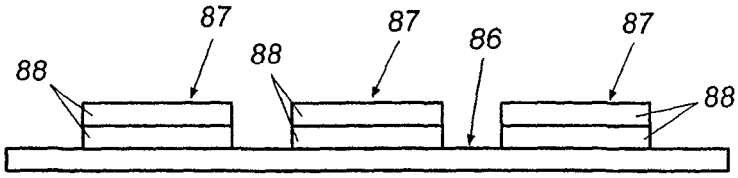

FIG. 6*f* shows the possibility of applying multiple reinforcing ribbons formed of multi-layer reinforcing ribbons at selected positions intermediate the edge portions of a base sheet. Multiple reinforcing ribbons 87 each formed of multiple layers of reinforcing ribbons 88 are applied to the base sheet at selected locations on the base sheet 86 not extending along the edge portions thereof.

Figure 6G:
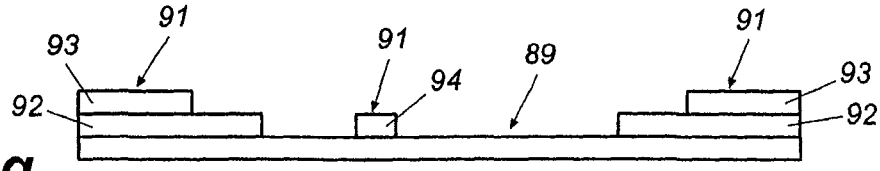

FIG. 6*g* illustrates a configuration possible with the method of the invention wherein one or more reinforcing ribbons 91 applied to a base sheet 89 is formed of multiple layers of reinforcing ribbons 92 and 93 the reinforcing ribbon 93 having a width less than the width of reinforcing ribbon 92. Any number of layers of ribbons may be applied in this manner to form multi-layer reinforcing ribbons with each ribbon of the strips having a width different from the widths of the other ribbons of the strips, according to application specific requirements. A relatively narrower reinforcing ribbon 94 is applied in FIG. 6*g* to the base sheet 89 at a selected location intermediate its edges. Thus, multiple reinforcing ribbons each having different widths may be applied at any desired location across the width of the base sheet through the method of the present invention.

Figure 6H:
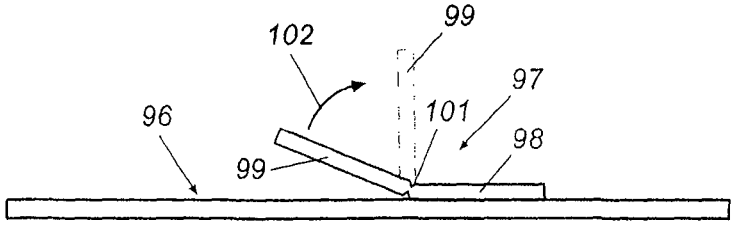

FIG. 6*h* illustrates a unique application of the method of this invention to form internal structures of a carton such as, for example, L-brackets, stiffeners, and separators. A ribbon 97 is applied to a base sheet 96 according to the method of the invention. In this case, however, the method includes applying adhesive along only one side of the ribbon before bonding the ribbon to the paperboard web. The ribbon 97 has a fold line 101 scored therein and the fold line separates the ribbon into a first section 98 and a second section 99. Adhesive is applied to the first section 98, which is bonded to the base sheet 96, and the second section 99 is free to be folded along fold line 101 as indicated by arrow 102 to project in a direction away from the base sheet 96.

The fold line 101 in the ribbon 97 may be scored at the scoring station 24 (FIG. 1) or, alternatively, the ribbon may be pre-scored prior to winding it onto a roll 19. Alternatively, the fold line may be formed during a platen or rotary in-line die cutting process. In any case, the second portion 99 of the ribbon functions in the final carton as an internally extending structure. Methods of providing adhesive to only a portion of the ribbon 97 as illustrated in FIG. 6*h* are known in the paperboard industry and may include, for example, masking techniques and/or spraying the adhesive onto the selected portion ribbon as it advances along the fabrication line 11 (FIG. 1).

Figure 7:
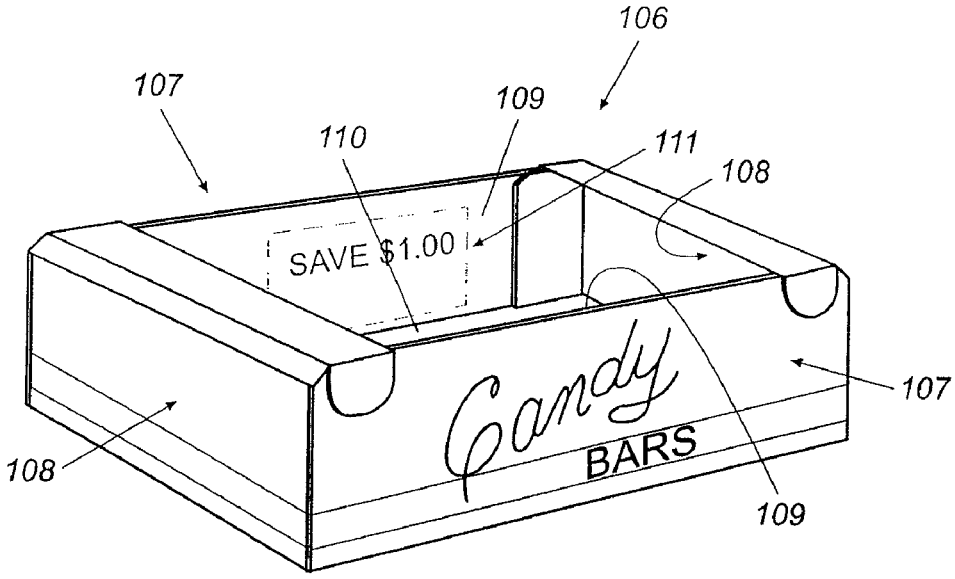
FIG. 7 is a perspective view of one configuration of a carton that embodies principles of the invention illustrating the results of pre-printing ribbons of reinforcing material with indicia according to one embodiment of the invention.

FIG. 7 illustrates one of the many possible configurations of cartons that may be made by the method of the present invention. The carton 106, which may, for example, be a shipping and display container for food items such as candy bars, is converted from a carton blank made according to the invention and has front and back walls 107, end walls 108, and a floor 110. The front and back walls 107 are structurally reinforced with paperboard reinforcing ribbons 109 applied to the insides of the panels that form the walls 107. Thus, the front and back walls 107 of the carton 106 exhibit enhanced strength and rigidity as a result of the reinforcing ribbons. These properties may be desirable, for example, to enhance the stackability of the cartons when packaged with product, to resist blow-out during shipment, or to provide resistance to tearing in the corners or other high stress locations of the carton.

Further according to the invention, the reinforcing ribbon 109 on the back wall 107 of the carton 106 is seen to have been pre-printed with indicia that is visible on the inside of the carton. Thus, the method of this invention may eliminate the requirement of double sided printing on a carton base sheet when it is desired to display indicia on the inside of a carton. In FIG. 7, the indicia 101 is illustrated as a savings coupon; however, any form of indicia such as, for example, instructions, contests rules, special graphics, or otherwise may be provided. Further, because the reinforcing ribbon is pre-printed, it may be provided with a coated or primed printing surface, which allows high-quality graphics to be printed on the reinforcing ribbon. This is an economical improvement over previous internal printing, which, as mentioned above, has been somewhat limited in available printing quality.

In addition or as an alternative to the printing of indicia, reinforcing ribbons may be pre-coated if desired with a moisture resistant or other type of coating. In such cases, the method of this invention may be used to make efficiently produced lined cartons for use as alternatives to cartons such a detergent boxes, which traditionally have been supplied with separate individually inserted moisture resistant liners.

Figure 8:
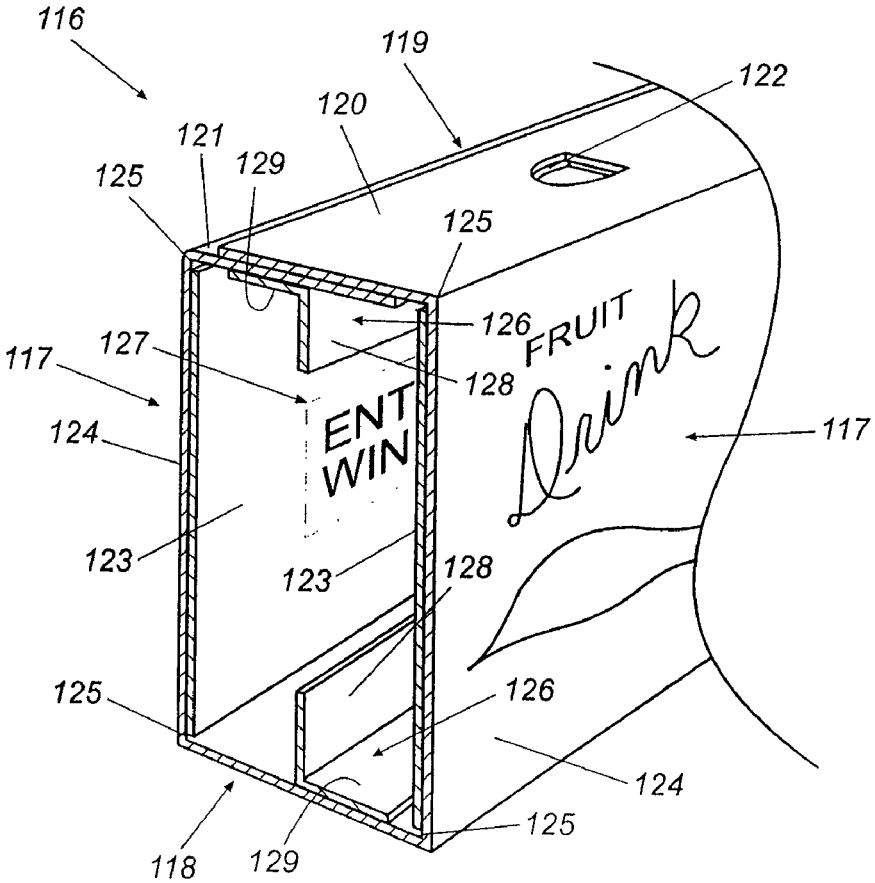
FIG. 8 is a perspective partially sectioned view illustrating another possible configuration of a carton formed by the method of the invention and showing various aspects of the invention.

FIG. 8 illustrates another configuration of a reinforced paperboard carton made according to the method of the invention. The end of the carton is shown in cross-section to illustrate better the internal structural components of the carton. The carton 116, which is illustrated as a carton for packaging fruit drink, is generally rectangular in shape and is folded along fold lines 125 to define side walls 117, a bottom wall 118 and a top wall 119. The top wall 119 is formed by overlapping flaps 120 and 121, which may be secured together by any appropriate means such as with adhesive, and may be provided with a cut-out 122 if desired to form a carrying handle. The side walls 117 have outside surfaces formed by respective panels 124. Reinforcing ribbons 123, which preferably also are made of paperboard, are applied to the side wall panels 124 on the inside of the carton according the invention and form the inside surfaces of the side walls 117. As previously discussed, the reinforcing ribbons 123 enhance the structural integrity of the side walls 117 to provide increased strength and rigidity in the sides of the carton for stackability and resistance to carton blow-out. At least one of the reinforcing ribbons 123 is seen to be printed with indicia 127 that is exposed on the inside of the carton and that may become apparent to a consumer as product is removed from the carton.

Paperboard dividers and stiffeners 126 are applied as described above relative to FIG. 6*h* to the bottom wall 118 and the top wall 119 on the inside of the carton 116. Each of the dividers and stiffeners is formed from a ribbon of paperboard applied according to the method of the invention and has a first portion 129 bonded to the respective wall and a second portion or flap 128 that is folded to extend internally into the carton. The flaps 128 may function to provide structural stiffness to the top and bottom walls and/or to provide spacers or protective separators for articles to be packaged in the carton. Indeed, a wide variety of internal carton structures previously provided by separate and expensive inserts may be made economically, efficiently, and virtually automatically using the method of the present invention.

FIGS. 9 through 13 illustrate a carton blank and scoring methodology that embody principles of the invention in another preferred form. More specifically, the embodiment of these figures includes a carton blank with longitudinal fold lines that are scored within regions reinforced by reinforcing ribbons rather than being located closely adjacent the edges of the ribbons, such as in FIGS. 4 and 5. Further, this embodiment includes transverse fold lines that transition from the thinner or lower caliper base sheet of the blank to the thicker laminated regions where reinforcing ribbons are applied. In other words, some fold lines cross the edges of laminated reinforcing ribbons. As is known by those of skill in the art, fold lines in thinner material must be narrower than fold lines in thicker material. For example, for a standard 26 point paperboard (0.026 inches thick), the appropriate fold line for producing a sharp structurally sound fold without cracking the outer coating of the paperboard typically is impressed with a 3 to 4 point scoring rule (i.e. a rule that is from 0.003 to 0.004 inches thick) in a platen or in-line rotary die cutter. However, to produce an acceptable fold in thicker 44 point paperboard material, a 6 point rule is advisable for scoring the fold line. To use a thinner rule with this thicker material results in cracking and damage to the paperboard when it is folded along the fold line. Conversely, to use, for example, a 6 point rule to produce fold lines in, for instance, a thinner 26 point paperboard results in folds that are too rounded and lack the crisp appearance and structural integrity required in the final carton.

The forgoing physical limitations and requirements give rise to problems in laminated ribbon reinforced carton blanks made according the present invention when fold lines are required to transition from a region of the blank formed only of thinner base sheet material and a region that is thicker because it is reinforced with laminated ribbons. More particularly, heretofore there have been no known methods of forming a continuous fold line with platen or rotary die cutters that is thicker along one section of its length (the section that is to score a fold line in the thicker ribbon reinforced region of the blank) and thinner along an adjacent section (the section that is to score a fold line in the thinner base-sheet-only region of the blank). Furthermore, even if such a multi-point fold line could have been formed, the margin of error of up to one-eighth of an inch in positioning reinforcing ribbons with some machinery would result in a portion of the thinner fold line sometimes extending into the thicker laminated region or vice versa. Such a condition is unacceptable because it results in tearing, cracking, and other damage at the location of the edge of the reinforcing ribbon when the carton blank is folded to form a carton.

The carton blank and fabrication technology illustrated in FIGS. 9 through 13 represent a unique method of making a multi-point or varying width continuous rule in a die cutter head for forming a continuous fold line that is thicker along one section of its length where thicker paperboard is to be scored and thinner along an adjacent section where thinner paperboard is to be scored. An equally unique methodology for transitioning between the two regions is disclosed that produces fold lines which allow for typical margins of error in positioning reinforcing ribbons. These discoveries and inventions are discussed in detail in the immediately following portion of this disclosure.

Figure 9:
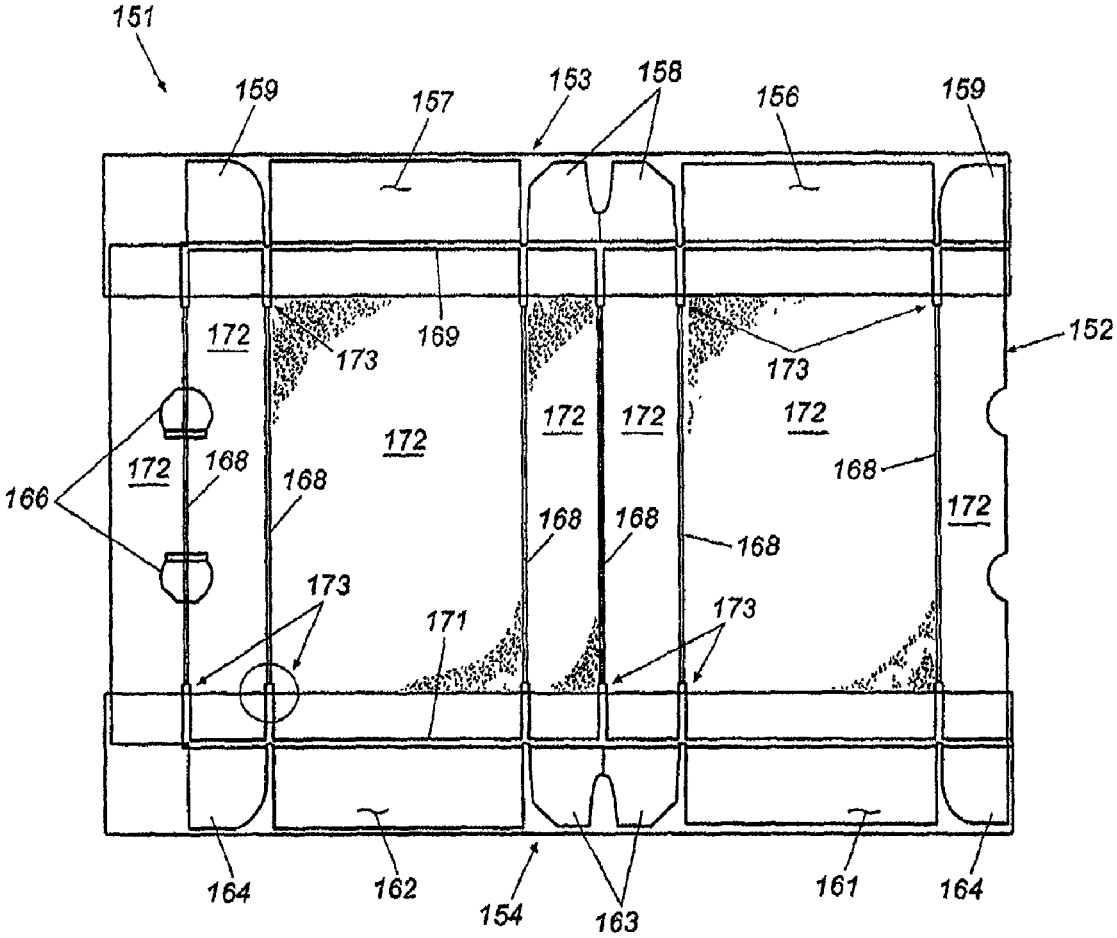
FIG. 9 is a top plan view of a carton blank according to the invention wherein fold lines are specially configured to transition from the thinner base sheet to the thicker laminated reinforced regions.

Referring to FIG. 9, a laminated reinforced carton blank 151 has a paperboard base sheet 152, to the edges of which upper and lower ribbons of reinforcing material 153 and 154 are laminated according to the forgoing discussions. The blank 151 generally is shown as it appears after having been cut and scored in a platen or rotary die cutter. More specifically, the blank is cut along its top edge to form end flaps 156 and 157, and end tabs 159 and 159. Similarly, the blank 151 is cut along its bottom edge to form end flaps 161 and 162, and end tabs 163 and 164. These flaps and tabs form the closed ends of a finished carton formed from the blank 151, as is known in the art. It will be understood that in FIG. 9, the complete outlines of the reinforcing ribbons 153 and 154 are shown for clarity of discussion and understanding; however, in reality the end flaps are cut completely through the reinforcing ribbons and the underlying base sheet.

Transverse fold lines 168 are scored generally across the blank and these fold lines define the various panels 172 of the blank, which ultimately will become the sides of the finished carton. Longitudinal fold lines 169 and 171 are scored along the blank 151 adjacent the end flaps and end tabs to allow for the folding up of the flaps and tabs in forming a carton. Regarding the longitudinal fold lines, it will be seen that they are located within the regions of the blank 151 that are reinforced by the reinforcing ribbons 153 and 154 rather than along the edges of reinforcing ribbons as in the embodiment of FIGS. 4 and 5. The transverse fold lines 168 intersect at their ends with the longitudinal fold lines 169 and 171. Accordingly, the transverse fold lines transition across the edges of the reinforcing ribbons 153 and 154 at positions referred to herein as transition zones 173.

As discussed above, fold lines and portions of fold lines located in non-reinforced regions of the blank 151 where the total material thickness is equal to the thickness of the base sheet are thinner than fold lines and portions of fold lines located in thicker reinforced regions, where the total thickness is the sum of the thickness of the base sheet and the thickness of the reinforcing ribbons. For example, with a standard 26 point base sheet with 18 point reinforcing ribbons (total thickness of 44 points in the reinforced regions), fold lines located only in the base sheet typically are formed with a narrower 3 or 4 point rule while fold lines in reinforced regions may be formed with a wider 6 point rule. Thus, a transition from a narrower fold line to a wider fold line occurs at the transition zones 173. These transition zones, the configuration and formation of which is discussed in more detail below, must be formed so as to allow for the margin of error in locating the reinforcing ribbons without causing cracking and paperboard damage when the carton blank is folded along transverse fold lines 168.

Figure 10:
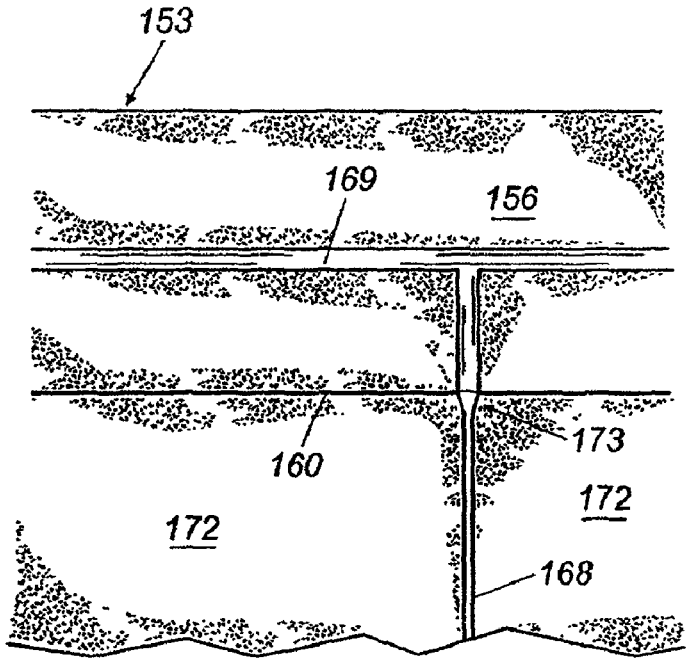
FIG. 10 is an enlarged view of a fold line transition illustrated in FIG. 9

FIG. 10 is an enlarged illustration of a section of the carton blank of FIG. 9 showing more clearly a transition zone 173 where a fold line 168 crosses the edge 160 of a reinforcing ribbon 153. Longitudinal fold line 169, which extends along the ribbon 153, is shown intersecting transverse fold line 168 at its end. As is more clearly seen in this figure, the fold lines and portions of fold lines in thicker regions of the blank where the laminated reinforcing ribbon 153 is located are wider than fold lines and portions of fold lines in thinner regions where there is only base sheet material. Within the transition zone 173, the width of the fold line 168 is seen to increase gradually and smoothly from its narrower to its wider dimension. In practice, it has been found that a preferred length of the transition zone, i.e. the distance from the end of the narrower section of the fold line to the beginning of the wider section, is about one-eighth of an inch (0.125 inches). It has been discovered that so long as the edge of the reinforcing ribbon falls within the gradually widening transition zone of the fold line, cracking and damage at the position of the edge of the reinforcing ribbon when the blank is folded along the fold line is eliminated. Most preferably, the reinforcing ribbon is positioned so that its edge falls nearer the wider end of the of the transition zone. However, even when margins of error in positioning reinforcing ribbons locates an edge of a ribbon nearer the narrow end but still within the transition zone, damage and cracking at this location when the blank is folded along the fold line still is eliminated.

A one-eight inch long transition zone is selected in the preferred embodiment because well maintained paperboard making machinery should be able to position the reinforcing ribbons with a margin error of less that one-sixteenth of an inch, insuring that the edges of the ribbons always fall within a transition zone. Even older or poorly maintained machinery should be able to maintain a margin of error of less that one-eight of an inch, insuring in all cases that the edge of the reinforcing ribbons cross fold lines within transition zones. Nevertheless, transition zones may well be configured to be less than or more than one-eighth of an inch long according to application specific constraints. Thus, a one-eight inch long transition zone should not be considered to be a limitation of the invention disclosed and claimed herein.

Figure 11:
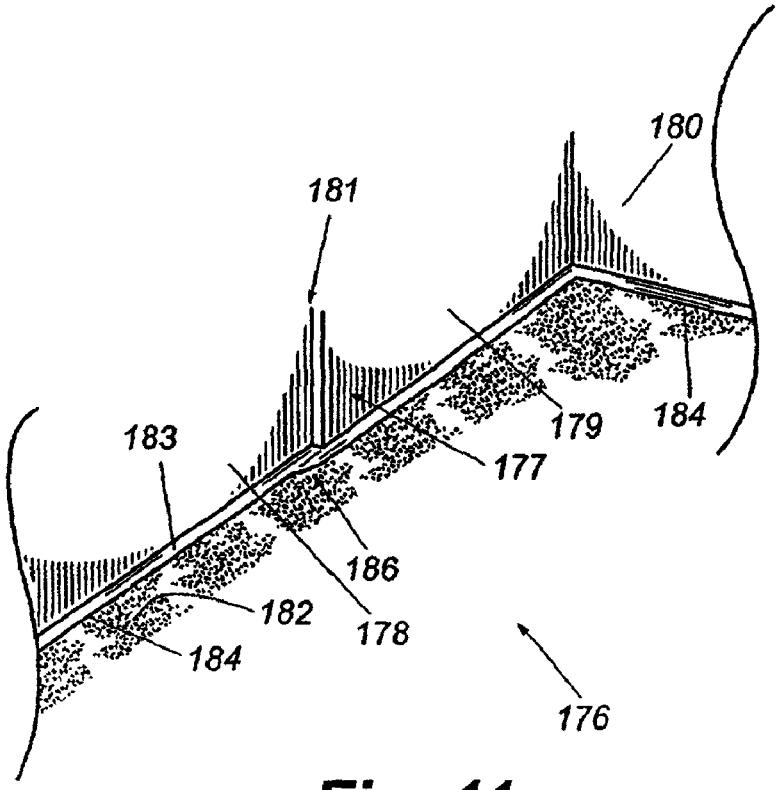
FIG. 11 is a partial perspective view of a scoring rule and corresponding counter plate configuration usable to form the transitioned fold lines of FIGS. 9 and 10.

FIG. 11 illustrates a rule and counter plate configuration in a platen die cutter for forming the transitioned fold lines shown in FIGS. 9 and 10. As is known by those of skill in the art, a platen die cutter generally includes a rigid metal table or bed and a head movable toward and away from the bed. Embedded within and projecting a short distance downwardly from the head are thin metal knives and thin metal blades forming a scoring rule. A relatively thin counter plate is located on the bed and the counter plate is formed with grooves aligned with the scoring rule. In use, a paperboard blank is positioned on the bed and the head is pressed with considerable force against the blank and the bed. As a result, the knives of the head cut through the blank to form the outline of the cut carton blank, i.e. to form the various flaps and tabs of the blank. At the same time, the blades of the scoring rule and aligned grooves in the counter plate compress the paperboard along their lengths to form the various fold lines in the blank (See FIG. 9). The same general principal applies to in-line rotary dies. The general construction and operation of platen and in-line rotary die cutters is understood by those of skill in the art and thus need not be discussed in more detail here, except with respect to the configuration of a multi-point rule and corresponding counter plate configurations for forming transitioned fold lines according to the invention.

With the forgoing in mind, FIG. 11 illustrates a rule 177 projecting downwardly from the head (not shown) of a platen die cutter toward the metal bed 183 of the cutter. An intersecting rule 180 is also illustrated. A portion of the counter plate 182 of the platen die cutter is shown formed with grooves 184 that are aligned with the rule sections 177 and 180. In use, a paperboard blank is inserted atop the bed and the counter plate and the head is brought down with pressure atop the blank. The rule 177 and 180 engages and compresses the blank along their blades and deforms the blank slightly into the grooves 184, thereby forming fold lines in the blank, generally in the traditional way. However, the combination of elements shown in FIG. 11 is unique in that these elements are configured to form the transitioned fold lines of the present invention. More specifically, the rule 177 is made up of a thinner or lower point rule section 178 for scoring thinner material of the blank and a wider or higher point rule section 179 for scoring adjacent thicker material of the blank. The rule sections 178 and 179 abut one another at butt joint 181, thus forming a continuously extending multi-point rule 177.

The portion of the groove 184 in the counter plate 182 that is aligned with and underlies the lower point rule section 178 has a width that is appropriate for complementing the thickness of the rule section 178 when scoring fold lines. Similarly, the portion of the groove 184 that is aligned with and underlies the higher point rule section 179 has a width that complements the thickness of the rule section 179 when scoring fold lines. A transition region 186 of the groove 184 generally underlies the butt joint 181 of the rule 177. The transition region 186 is seen to be formed with a gradually and smoothly increasing width that transitions from the narrow portion of the groove 184 to the wider portion of the groove. In practice, as discussed above, the length of the gradually widening transition region 186 preferably is about one-eighth of an inch. The butt joint 181 preferably is aligned near or at the wider portion of the transition region 186. With such a configuration, a fold line with a transition zone of about one-eight of an inch in length is formed in a paperboard blank, as discussed above relative to FIG. 10.

Figure 12:
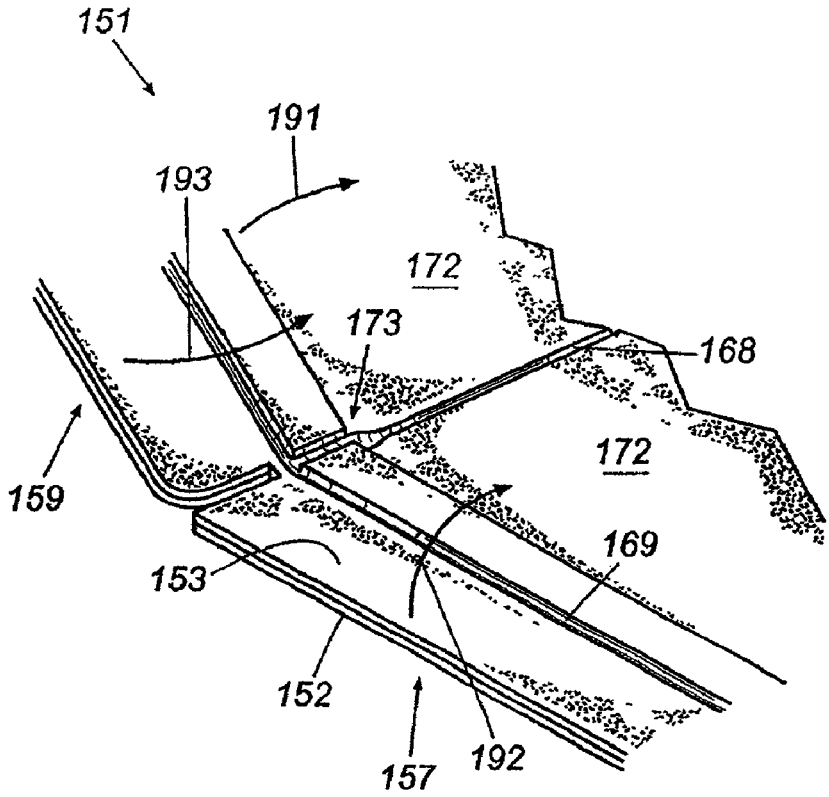
FIG. 12 is a partial perspective view of a section of a carton blank illustrating the folding of the blank along a transitioned fold line.

FIG. 12 illustrates a section of a reinforced carton blank after having been cut and scored with fold lines according to principles of the present invention. The sizes of the fold lines in this figure are somewhat exaggerated for clarity of discussion. As in FIG. 9, the blank 151 has a paperboard base sheet 152 and a reinforcing ribbon 153 is laminated to the base sheet along its outside edge. A longitudinal fold line 169 is formed along the reinforcing ribbon and a transverse fold line 168 intersects at its end with the longitudinal fold line 169. The fold lines define panels 172, flaps 157, and tabs 159, as discussed above relative to FIG. 9. The transverse fold line 168 crosses the edge of the reinforcing ribbon 153 at transition zone 173 and, according to the invention, transitions the fold line 168 from its narrower width in the base-sheet-only region of the blank to its wider width within the reinforced region of the blank. Arrows 191, 192, and 193 indicate the folding of the blank 151 along its fold lines in the formation of a carton from the blank. As discussed above, the location and configuration of the transition zone 173 insures against damage and cracking at the location of the intersection of the fold line 168 with the edge of the reinforcing ribbon when the blank is folded along the fold line 168, as indicated by arrow 191.

Figure 13:
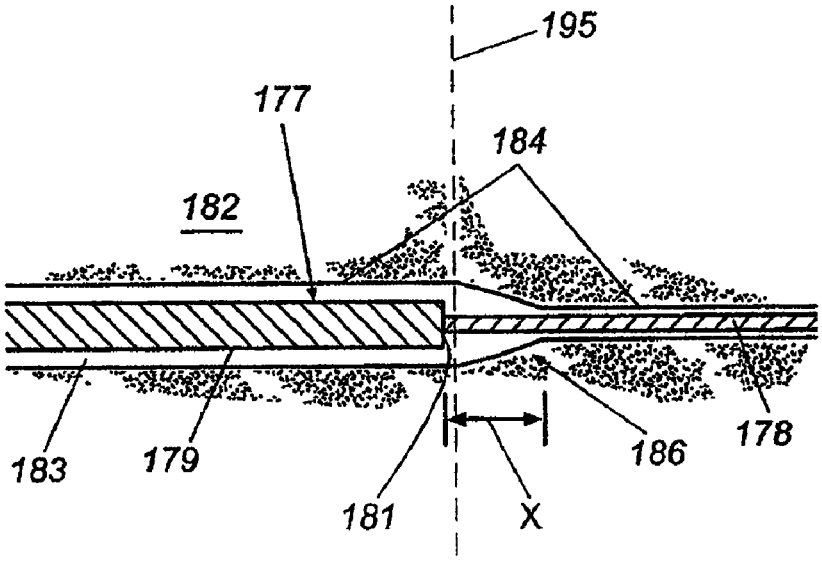
FIG. 13 is a longitudinally sectioned view through a scoring rule and counter plate configuration for creating transitioned fold lines according to the invention.

FIG. 13 is a longitudinally sectioned view through the rule 177 of FIG. 11 looking downwardly toward the bed of platen die cutter. As discussed above, the rule 177 is formed with a relatively thinner rule section 178 and a relatively wider rule section 179 butted at butt joint 181. Counter plate 182 underlies the rule 177 and is formed with an aligned groove 184. The portion of the groove 184 underlying the narrower rule section 178 is narrower than the portion of the groove underlying the wider rule section 179. A smoothly contoured transition zone 186 transitions between the narrower and wider portions of the groove 184. The transition zone 186 has a length X from the end of the narrower portion of the groove to the beginning of the wider portion. As discussed above, for forming the ribbon reinforced carton blanks of the present invention, X preferably is about one-eighth of an inch; however, other lengths may be used depending upon particular application specific constraints. A preferred positioning of an edge 195 of a reinforcing ribbon relative to the rule and groove is illustrated in phantom lines. Specifically, the ribbon preferably is positioned on a base sheet such that its edge 195 crosses the groove 184 nearer the wider end of the transition zone. However, it has been found that so long as the edge falls generally within the transition zone, cracking and carton damage upon folding is virtually eliminated. Therefore, the transition zone of the present invention allows for typical margins of error in positioning reinforcing ribbons, as discussed above.

Figure 14:
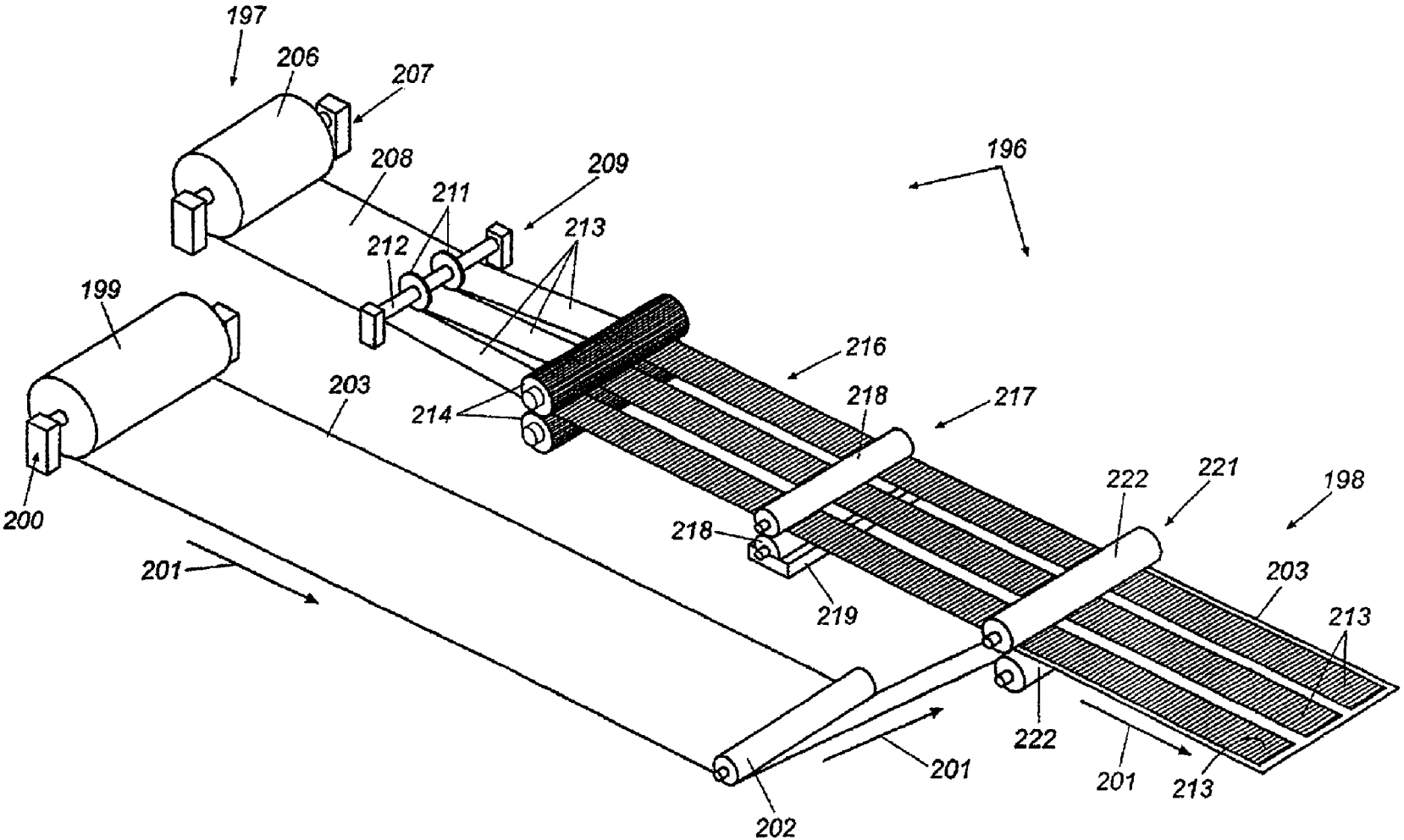
FIG. 14 is a perspective illustration of a method of making reinforcing ribbons that are deformed in a desired configuration prior to being adhered to a paperboard base sheet.

FIGS. 14 through 17 illustrate yet another embodiment of the invention wherein ribbons of reinforcing material may be deformed or altered for a particular purpose prior to being adhered to a paperboard base sheet. Referring to FIG. 14, a fabrication line 196 has an upstream end 197 and a downstream end 198. A roll 199 of paperboard base sheet is rotatably disposed on a mandrel 200 at the upstream end 197 of the fabrication line. A web 203 of paperboard base sheet is drawn progressively from the roll 199 and moves generally in a downstream direction along a path 201. A roll 206 of paperboard reinforcing material is rotatably mounted on a mandrel 207, also located at the upstream end 197 of the fabrication line. A web 208 of reinforcing material is drawn from the roll 206 and moves in a downstream direction generally along the direction of the path 201. A slitting station 209 is disposed downstream of the global roll 206 of reinforcing material and includes a shaft 212 to which a plurality of slitting wheels are mounted. As the web 208 of reinforcing material moves past the slitting section, it is cut or slit to form individual reinforcing ribbons 213, which are spread out by a spreader (not shown) to move along separate selectively positioned paths.

As the reinforcing ribbons 213 move further downstream, they pass between a pair of mated impression cylinders 214. The impression cylinders 214 have mating surfaces that are formed with a predetermined pattern so that the reinforcing ribbons 213 are deformed, altered, or embossed as the case may be into the pattern formed in the impression cylinders 214. In the illustration of FIG. 14, the impression cylinders are formed with intermeshing longitudinally extending teeth or ribs, which deform the reinforcing ribbons to exhibit laterally extending corrugations. However, as discussed below, the ribbons can be deformed to exhibit a wide variety of shapes and profiles according to application specific requirements.

From the impression cylinders, the altered reinforcing ribbons move downstream to a gluing station 217, which, in the illustrated embodiment, includes a pair of nip rollers 218. The lower nip roller 218 is partially submerged in a flooded nip bath 219 that contains an appropriate liquid adhesive. As the altered reinforcing ribbons pass between the nip rollers, a coating of adhesive is applied to the underside of the ribbons. Of course, other types of adhesive applicators such as, for example, spray applicators may be substituted for the nip roller arrangement of FIG. 14.

From the gluing station 217, the adhesive bearing altered reinforcing ribbons continue to move in a downstream direction toward a compression station 221. At the same time, the web 203 of base sheet material passes under an idler roller 202 and is redirected upwardly toward the compression station 221. Thus, both the base sheet web and the reinforcing ribbons move together toward the compression station. At the compression station, the base sheet web and the reinforcing ribbons come together and pass between a pair of compression rollers 221 and 222 where sufficient pressure is applied to adhere the adhesive bearing altered reinforcing ribbons to the base sheet. Thus, a ribbon reinforced paperboard blank is formed as in other embodiments, but in this embodiment the reinforcing ribbons are corrugated or otherwise deformed or altered to serve a particular purpose. From the compression station, the web may move to an in-line rotary die cutter, a sheet cutter, a platen die cutter, or otherwise to cut and form the web into carton blanks as described above.

Figure 15:
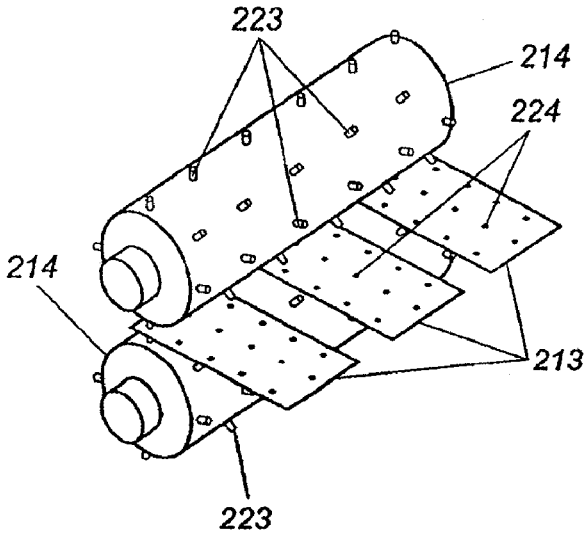
FIG. 15 is a perspective illustration of one possible configuration of impression cylinders for perforating paperboard ribbons to provide enhanced adhesion prior to adhering the ribbons to a base sheet.
Figure 16:
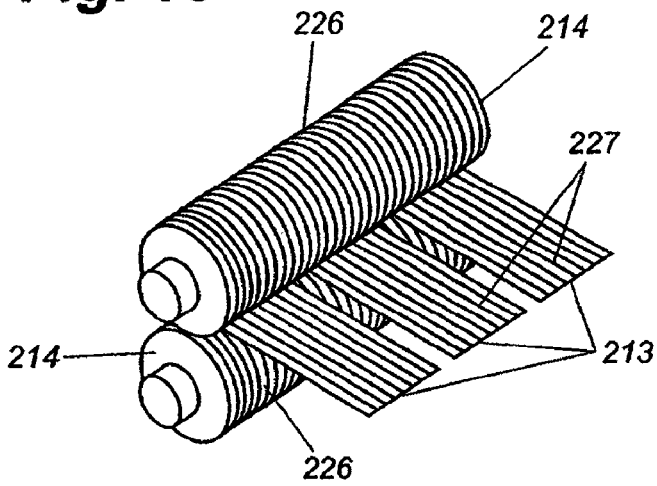
FIG. 16 is a perspective illustration of another possible configuration of impression cylinders for deforming paperboard ribbons to form longitudinal flutes prior to adhering the ribbons to a base sheet.
Figure 17:
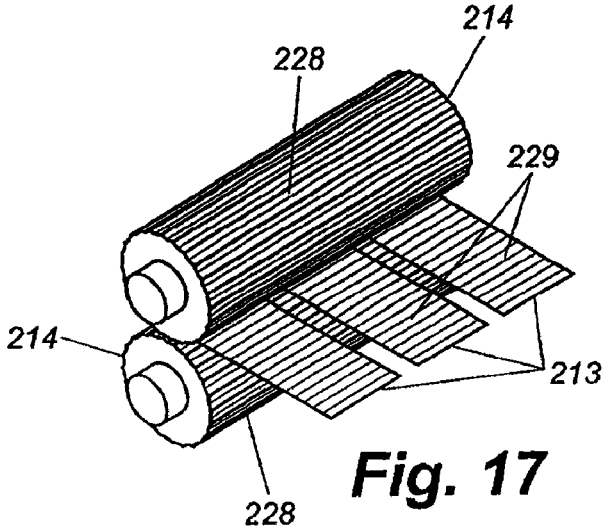
FIG. 17 is a perspective illustration of yet another possible configuration of impression cylinders for deforming paperboard ribbons to form lateral corrugations prior to adhering the ribbons to a base sheet.

FIGS. 15 through 17 illustrate three possible configurations of impression cylinders usable in the fabrication line of FIG. 14 to deform or alter the reinforcing ribbons before they are applied to the base sheet to form reinforcing ribbons. In some instances, it may be desirable to perforate the reinforcing ribbons with an array of perforations. For instance, where superior adhesive bonding of the ribbons to a base sheet is required, perforations in the ribbons allow the adhesive to flow through the perforations to form an interlocking bond between the reinforcing ribbons and the adhesive layer. To obtain such perforations, impression cylinders 214 may be provided with arrays of spikes or punches. As the reinforcing ribbons 213 pass between the impression cylinders, the spikes or punches penetrate the ribbons and form an array of perforations 224 therein. The perforated ribbons then proceed to the gluing station and the compression station, where they are adhered to the base sheet to form laminated reinforced carton blanks.

FIG. 16 illustrates another possible configuration of impression cylinders for deforming the reinforcing ribbons prior to their application to the base sheet. Here, the impression cylinders 214 have surfaces formed with a series of side-by-side circumferentially extending fluting grooves with the grooves of the top cylinder meshing with the grooves of the bottom cylinder. As the reinforcing ribbons 213 pass between these impression cylinders, they are deformed to exhibit an array of longitudinally extending flutes. The fluted reinforcing ribbons them move downstream where they are adhered to the base sheet to form ribbon reinforced carton blanks.

Finally, FIG. 17 illustrates a pair of impression cylinders 214 for forming transverse corrugations in the reinforcing ribbons as illustrated in the example of FIG. 14. Here, the surfaces of the impression cylinders 214 are formed with an array of longitudinally extending teeth 228 that mesh together when the cylinders rotate to deform the reinforcing ribbons 213 to exhibit transverse corrugations 229. As with the other embodiments, the corrugated ribbons then pass downstream where they are adhered to the base sheet to form ribbon reinforced carton blanks.

While three different examples of impression cylinders have been illustrated above, it should be understood that a wide variety of different impression cylinders may be fabricated to form an equally wide variety of deformations or alterations to the reinforcing ribbons before they are applied to the base sheet. For example, patterns, designs, words, or other indicia may be embossed into the ribbons as desired. Other patterns for enhancing the strength and structural integrity of the ribbons such as, for example, dimples or "egg crate" patterns may be formed to produce exceedingly strong reinforcing ribbons. Accordingly, it will be seen that the embodiments of FIGS. 14 through 16 are examples only. The invention is intended and should be interpreted to encompass any types of deformations or other alterations that might be made to the reinforcing ribbons prior to adhering them to the base sheet to produced enhanced ribbon reinforced carton blanks.

The invention has been described herein in terms of preferred embodiments and methodologies, which represent the best mode known to the inventors of carrying out the invention. It will be understood by those of skill in the art, however, that many additions, deletions, modifications, and substitutions of equivalent elements not specifically included in the preferred embodiments may be made without departing from the spirit and scope of the invention as set forth in the claims.

What is claimed is:

1. A method of making reinforced paperboard cartons comprising the steps of:

(a) advancing a web of paperboard along a path, the web of paperboard having a width;

(b) progressively applying at least one ribbon of reinforcing material to the advancing web of paperboard to form a reinforced region for the carton, the ribbon having a width less than the width of the web of paperboard and an edge;

(c) forming at least one fold line in the web of paperboard, the at least one fold line extending transversely to the reinforcing region and crossing the edge of the ribbon of reinforcing material to define (1) a first section within the reinforced region and a second section outside the reinforced region, the first section of the at least one fold line being wider than the second section of the at least one fold line, and (2) a transition zone between the first and second sections of the at least one fold line;

(d) the at least one fold line being formed by (i) positioning the paperboard between a multi-point scoring rule having a narrower scoring rule section outside the reinforced region and a wider scoring rule section inside the reinforced region and a counter plate located beneath the scoring rule, the counter plate including a groove aligned with the scoring rule, the groove having a narrower groove section aligned with the narrower scoring rule section, and a wider groove section aligned with the wider scoring rule section, the groove gradually widening from the narrower groove section to the wider groove section to form the transition zone, and (ii) impressing the paperboard with the multi-point scoring rule to form the at least one fold line.

2. The method of claim 1 wherein the transition zone has a length of approximately one-eighth inch.

3. The method of claim 2 and where in step (c) the fold line widens smoothly from the second to the first sections of the at least one fold line.

4. The method of claim 2 and wherein the edge of the reinforcing ribbon is located within the transition zone nearer the wider portion of the at least one fold line.

5. The method of claim 1 and wherein the scoring rule is part of a platen die cutter.

6. The method of claim 1 and wherein the scoring rule is part of an in-line rotary die cutter.

7. The method of claim 1 and wherein the junction between the narrower and the wider scoring rule sections is aligned with the wider end of the transition zone.

8. A method of scoring a fold line in a paperboard carton blank having a base sheet of paperboard and a reinforced region formed by a reinforcing ribbon laminated to the base sheet wherein the fold line extends transversely to the reinforced region and transitions from outside the reinforced region to inside the reinforced region, the method comprising the steps of:

(a) providing a multi-point scoring rule having a narrower first section for scoring the portion of the fold line outside the reinforced region and a wider second section for scoring the portion of the fold line within the reinforced region;

(b) positioning the paperboard carton blank between the multi-point scoring rule and a counter plate, the counter plate being formed with a groove aligned with the scoring rule, the groove having a narrower groove section aligned with the narrower first section of the scoring rule, a wider groove section aligned with the wider second section of the scoring rule, and a transition region between the narrower groove section and the wider groove section to form the fold line with a transition zone corresponding to the transition region at an edge of the reinforcing ribbon; and (c) impressing the paperboard carton blank with the multi-point scoring rule to form the fold line in the paperboard carton blank.

9. The method of claim 8 and wherein the transition region of the groove comprises a gradually widening section of the groove from the narrower groove section to the wider groove section.

10. The method of claim 9 and wherein the transition region of the groove is about 0.125 inches long.

11. A method of making reinforced paperboard carton blanks comprising the steps of:

(a) advancing a web of paperboard along a path, the web of paperboard having a width;

(b) progressively applying at least one ribbon of reinforcing material to the advancing web of paperboard at a predetermined position to form a reinforced region for the carton, the ribbon having a width less than the width of the web of paperboard and an edge, the position of the ribbon on the advancing web being subject to a margin of error;

(c) forming carton blanks from the web and scoring at least one fold line in each carton blank, the at least one fold line extending transversely to the reinforced region and crossing the edge of the ribbon of reinforcing material to define a fold line having a first section within the reinforced region and a second section outside the reinforced region, the first section of the fold line being wider than the second section of the fold line; and (d) forming a transition zone between the first and second sections of the fold line, the transition zone comprising a widening of the fold line from the narrower second section of the fold line to the wider first section of the fold line, the length of the transition zone being at least as great as the margin of error, whereby the edge of the ribbon falls within the transition zone.

12. The method of claim 11 wherein the length of the transition zone is greater than the margin of error.

13. The method of claim 11 and where in step (d) the transition zone widens smoothly from the narrower second section to the wider first section of the fold line.

14. The method of claim 11 and wherein the edge of the reinforcing ribbon is located within the transition zone nearer the wider first section of the fold line.

15. The method of claim 11 and wherein step (c) further comprises impressing the paperboard with a multi-point scoring rule having a narrower scoring rule section outside the reinforced region and a wider scoring rule section inside the reinforced region.

16. The method of claim 15 and wherein the scoring rule is part of a platen die cutter.

17. The method of claim 15 and wherein the scoring rule is part of an in-line rotary die cutter.

18. The method of claim 15 and wherein step (c) further comprises locating a counter plate beneath the scoring rule, the counter plate being formed with a groove aligned with the scoring rule, the groove having a narrower groove section aligned with the narrower scoring rule section and a wider groove section aligned with the wider scoring rule section.

19. The method of claim 18 and where in step (d) the transition zone is formed by gradually widening the groove in the counter plate from the narrower groove section to the wider groove section.

20. The method of claim 19 and wherein the junction between the narrower and the wider scoring rule sections is aligned with the wider end of the transition zone.

21. The method of claim 2, wherein the margin of error is less than one-sixteenth inch.

22. The method of claim 8, wherein the reinforcing ribbon is positioned on the base sheet with a margin of error, and the transition region of the groove has a length sufficient to insure that the edge of the ribbon will cross the transition zone of the fold line for any position of the ribbon within the margin of error.

* * * * *